US006728638B2

(12) United States Patent
Newman

(10) Patent No.: US 6,728,638 B2
(45) Date of Patent: Apr. 27, 2004

(54) METHOD OF MONITORING OPERATIONS OF MULTIPLE SERVICE VEHICLES AT A WELL SITE

(75) Inventor: Frederic M. Newman, Midland, TX (US)

(73) Assignee: Key Energy Services, Inc., Midland, TX (US)

( * ) Notice: Subject to any disclaimer, the term of this patent is extended or adjusted under 35 U.S.C. 154(b) by 80 days.

(21) Appl. No.: 09/838,857

(22) Filed: Apr. 23, 2001

(65) Prior Publication Data

US 2002/0156582 A1 Oct. 24, 2002

(51) Int. Cl.[7] ..... G01V 3/38; G01V 3/00
(52) U.S. Cl. ..... 702/5; 340/854.6
(58) Field of Search ..... 702/5, 45; 340/854.6; 166/53

(56) References Cited

U.S. PATENT DOCUMENTS

| | | | | |
|---|---|---|---|---|
| 3,760,362 A | | 9/1973 | Copland | |
| 3,921,152 A | | 11/1975 | Hagar | |
| 4,187,546 A | | 2/1980 | Heffernan et al. | |
| 4,393,485 A | | 7/1983 | Redden | |
| 4,531,204 A | | 7/1985 | Vanderschel | |
| 4,545,017 A | | 10/1985 | Richardson | |
| 4,604,724 A | | 8/1986 | Shaginian et al. | |
| 4,794,534 A | | 12/1988 | Millheim | |
| 4,916,617 A | | 4/1990 | Norwood | |
| 5,051,962 A | | 9/1991 | Eaton | |
| 5,132,904 A | | 7/1992 | Lamp | |
| 5,216,638 A | | 6/1993 | Wright | |
| 5,237,539 A | | 8/1993 | Selman | |
| 5,278,549 A | | 1/1994 | Crawford | |
| 6,079,490 A | * | 6/2000 | Newman | 166/77.51 |
| 6,241,020 B1 | * | 6/2001 | Newman | 166/250.01 |
| 6,377,189 B1 | * | 4/2002 | Newman | 340/854.6 |

* cited by examiner

*Primary Examiner*—John Barlow
*Assistant Examiner*—Toan M Le
(74) *Attorney, Agent, or Firm*—Howrey, Simon, Arnold, & White, LLP

(57) ABSTRACT

A method of monitoring service operations performed on a well involves creating, directly at the well site, a cohesive report of what work was done to the well and which of several contractors did the work. The report includes supporting data generated by one or more transducers. The transducers sense various conditions of a process or service operation, which is being performed by a contractor with the assistance of a special service vehicle. The report is computer generated and can be conveyed from a remote well site to a home base location using two computers communicating across a wireless communication link. The method is particularly useful when the work at the well involves several independent contractors using different service vehicles to perform different service operations.

20 Claims, 2 Drawing Sheets

84
34
90
44
92
96
101
110
108
114
112
106
28
78
80
84
34
118
30
90
102
92
104
96
76
21
14
4
56
48
46
86
70
6
5
58
68
15
60
16
3
2
32
1
72
88
82
11
13
12
74
116
86'
52
17
42
54
11-17
7
40
50
64
36
62
38

METHOD OF MONITORING OPERATIONS OF MULTIPLE SERVICE VEHICLES AT A WELL SITE

BACKGROUND OF THE INVENTION

1. Field of the Invention

The invention generally pertains to service vehicles used in performing work at a well site, and more specifically to a method of monitoring the operations of multiple service vehicles.

2. Description of Related Art

After a well is set up and operating to draw petroleum, water or other fluid up from within the ground, various replacement parts and services are periodically provided to maintain the well. Such parts and services may include replacing worn parts such as a pump, sucker rods, inner tubing, and packer glands; pumping chemical treatments or hot oil down into the well bore; and pumping cement into the well bore to partially close off a portion of the well (or to shut it down entirely). Since wells are often miles apart from each other, the maintenance or service operations are usually performed by a mobile unit or service vehicle having special onboard servicing equipment suited to perform the work. Some examples of service vehicles include a chemical tank truck or trailer, a cement truck or trailer, a hot-oiler tank truck or trailer, and a portable work-over service rig having a hoist to remove and install well components (e.g., sucker rods, tubing, etc.).

Service vehicles are often owned by independent contractors that well companies (e.g., well owner or operator) hire to service the wells. For a single well servicing project, a well company may hire several different contractors, each having their own special equipment and areas of expertise. Each contractor may perform several different service operations. For example, one contractor with a work-over rig may replace tubing, sucker rods, and perforate casing. Another contractor, with a tank truck, may stimulate the well and provide a hot oil treatment Yet, another contractor may deliver parts or provide rental equipment. With several independent contractors each doing several different jobs, the oil company may find it difficult to keep track of everything that is going on at the well site.

Consequently, some service operations may be done improperly or may be overlooked entirely. The oil company may receive invoices for work that was never performed. If an accident or some other notable incident occurs at the well site, it may be difficult to determine the cause or who was involved. If the various contractors each prepare their own service report, the well company may still need to sort through all the reports to determine what was done, who did it, and when it was done. Sorting through the various reports can be especially difficult and time consuming if each report follows a different format, which may be unique to each individual contractor.

SUMMARY OF THE INVENTION

To avoid the problems and limitations of current methods of monitoring operations at a well site, it is an object of the invention is to collect data directly at the well site, wherein the data identifies what was done and who did it.

A second object is to allow a contractor to specify what service operation is about to be performed by providing the contractor with a menu of service operations from which to choose.

A third object is to generate directly at the well site a cohesive report that identifies which service operation is supposedly being performed, a transducer reading that substantiates the service operation was actually being carried out, and which contractor was involved in doing the work.

A fourth object is to generate directly at the well site a cohesive report that identifies several service operations supposedly being performed, several transducer readings that substantiate that the service operations were actually being carried out, and which contractor was involved in doing the work.

A fifth object is to generate directly at the well site a cohesive report that identifies several service operations supposedly being performed, several transducer readings that substantiate that the service operations were actually being carried out, and a list of several independent contractors that were involved in doing the work.

A sixth object is to generate directly at the well site a cohesive report that identifies facts about an accident or an environmental incident that occurred at the well site.

A sixth object is to generate directly at the well site a cohesive report that identifies which service operation is supposedly being performed, a transducer reading that substantiates the service operation was actually being carried out, which contractor was involved in doing the work, and a time stamp that identifies when the service operation was being performed.

A seventh object is to generate directly at the well site a cohesive report that identifies which service operation is supposedly being performed, a transducer reading that substantiates the service operation was actually being carried out, and which employee was involved in doing the work.

An eighth object is to generate directly at the well site a cohesive report that identifies which service operation is supposedly being performed, a transducer reading that substantiates the service operation was actually being carried out, which contractor was involved in doing the work, and at which well site the work occurred.

A ninth object is to generates a report that summarizes the work performed by one or more contractors using one or more special service vehicles designed specifically to assist in performing certain service operations at a well site.

A tenth object is to further use such a service vehicle to transport a computer to the well site, wherein the computer is used to create a report that identifies the activities at the well site.

An eleventh object is to provide a wireless communication link between a first computer at a home base location and a second computer at a remote well site, so that report information collected on the second computer can be almost immediately communicated to the first computer, thereby providing a well company with timely access to the report.

A twelfth object is to validate that a service operation is actually being performed by sensing pressure or rotational speed of a motor associated with the service operation.

These and other objects of the invention are provided by a method of monitoring operations at a well site that involves collecting data directly at the well site, wherein the data identifies which service operation is supposedly being performed, a transducer reading that substantiates that the service operation was actually being carried out with the assistance of a service vehicle, and which contractor was involved in doing the work.

DESCRIPTION OF THE PREFERRED EMBODIMENT

Figure 1:
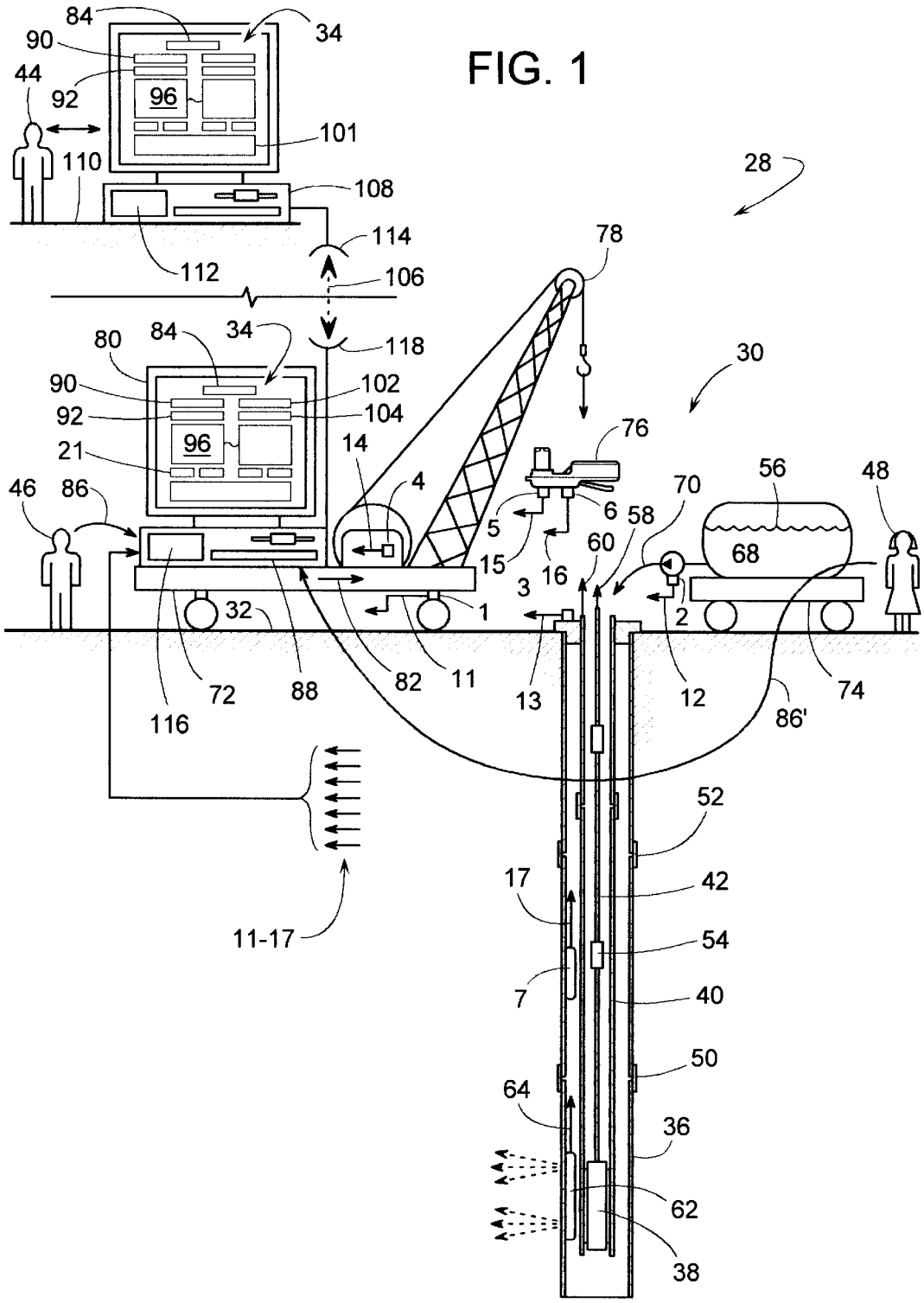
FIG. 1 is a schematic diagram illustrating a method of monitoring operations at a well site according to a currently preferred embodiment of the invention.
Figure 2:
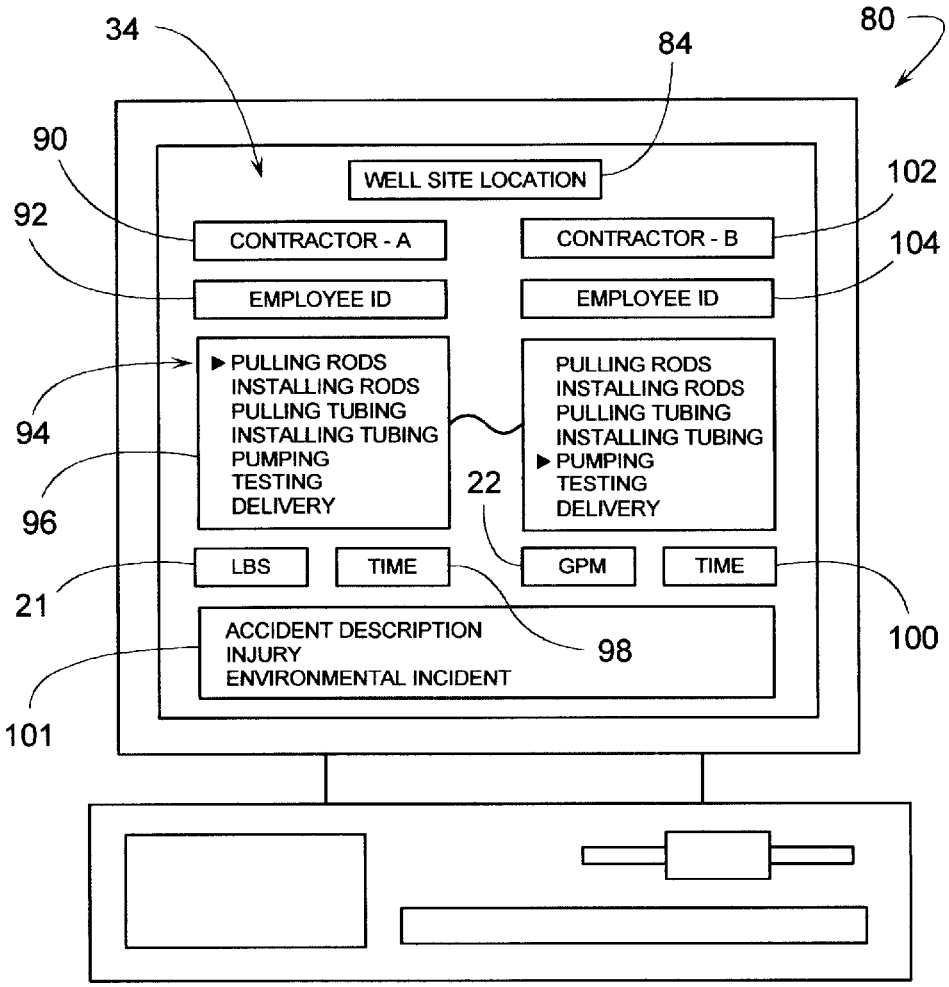
FIG. 2 schematically illustrates the basic elements of a report created by the method of FIG. 1, wherein the report is displayed on a monitor of a computer.

FIGS. 1 and 2 schematically illustrate a method 28 of monitoring activities pertaining to a well 30 at a well site 32, and summarizing the results in a cohesive report 34. Report 34 covers a variety of service operations performed by one or more contractors using one or more service vehicles.

Well 30 is schematically illustrated to encompass any apparatus for drawing a fluid (e.g., oil, gas, water, etc.) from the ground. In some embodiments of the invention, well 30 includes a string of outer piping known as casing 36. When perforated, casing 36 provides a conduit that conveys fluid from within the ground to the inlet of a submerged reciprocating pump 38. An inner string of pipe, known as tubing 40, provides a discharge conduit that conveys the fluid from the outlet of pump 38 to the surface. A powered pivoting beam (not shown) moves a string of sucker rods 42 up and down, which in turn moves the pump's piston up and down to pump the fluid.

To service or maintain well 30, an oil company 44 (e.g., well owner, operator, or representative thereof) hires one or more contractors 46 and 48 to provide the necessary goods and services. Examples of common parts that contractors 46 or 48 may replace at well site 32 include, but are not limited to, casing 36; tubing 40; sucker rods 42; pump 38 or its components, such as seals and valves; casing couplings 50; tubing couplings 52; sucker rod couplings 54; packer glands; and various parts associated with the pivoting beam, such as its drive motor. Examples of various consumable and non-consumable fluids 56 that may be added to the well bore include, but are not limited to hot oil, acid, or cement. Examples of common services operations that contractors 46 or 48 may perform at well site 32 include, but are not limited to, delivering parts; manipulating sucker rods (e.g., installing, torquing, or replacing rods 42, as indicated by arrow 58); manipulating tubing (e.g., installing, torquing, or replacing tubing 40, as indicated by arrow 60); perforating casing 36, as indicated by a perforating gun 62 suspended from a cable or wireline 64; down hole logging, as indicated by a transducer 7 also suspended from a wireline; pumping fluid 56 (e.g., cement, acid, steam, hot oil, etc.) into well 30, as indicated by pump 68 and arrow 70; welding; fracture treatments, testing; drilling; providing rental equipment; and various other work that is familiar to those skilled in the art. The list of possible goods (e.g., consumable and non-consumable parts and fluids) and services could be considered endless, as new components and services are continually being developed.

To provide the various goods and services, contractors 46 and 48 preferably use a service vehicle. The term, "service vehicle" refers to any vehicle used to facilitate delivering parts and/or performing one or more service operations on well 30. Examples of a service vehicle include, but are not limited to, mobile work-over unit 72 and a tanker 74. Work-over unit 72 includes a variety of equipment including, but not limited to, tongs 76 (e.g., rod tongs or tubing tongs), and a wireline winch and/or a hoist 78. Work-over unit 72 is particularly suited for removing and installing well components, such as sucker rods, tubing, etc.; lowering instruments into the well bore via a cable or wireline; and may even be used in actually drilling the well bore itself Tanker 74 is schematically illustrated to encompass all other types of service vehicles including, but not limited to, pumping vehicles, such as a chemical tank truck or trailer, a cement truck or trailer, and a hot-oiler tank truck or trailer.

One of the service vehicles, such as vehicle 72, also transports a computer 80 to well site 32, as depicted by arrow 82. The term, "computer" used herein and below refers to any device for storing and/or possessing digital information. Examples of a computer include, but are not limited to, personal computers, PC, desktop computer, laptop, notebook, PLC (programmable logic controller), data logger, etc. Computer 80 with common software (e.g., Microsoft Word, Excel, Access; Visual Basic; C++; etc.) allows contractor 46 to begin creating report 34 right at the well site.

For example, contractor 46 may begin by entering into computer 80 a well site identifier 84, such as an alphanumeric name, number, address or code that identifies (e.g., by name or location) well 30 or well site 32. The step of entering or identifying well site identifier 84 is schematically depicted by arrow 86, and can be accomplished manually by using a keyboard 88 or can be entered in some other conventional manner, such as scanning a bar code label, sensing a radio frequency identification device, or selecting from a menu of well site identifiers displayed on computer 80.

In a similar manner, contractor 46 may enter a contractor identifier 90, which identifies contractor 46 by name, number, or some other code that distinguishes one contractor from another. If desired, contractor identifier 90 may comprise an employee identifier 92, such as a name, number, or some other code that distinguishes one employee from another.

Contractor 46 may also enter or identify a service operation 94 (FIG. 2) that is about to be performed with the assistance of service vehicle 72. Identifying service operation 94 is preferably done by selecting from a menu of several service operations 96. For illustration, contractor 46 identifies or selects "Pulling Rods" (i.e., removing sucker rods) from menu 96. Menu 96 may include other service operations, such as Installing Rods, Pulling Tubing, Installing Tubing, Pumping, Testing, and Delivery (e.g., delivery of parts or rental equipment). Other examples of service operations that are well known to those skilled in the art and could be listed in menu 96 include, but are not limited to, perforating, stimulating, swabbing, drilling, and bailing. Upon selecting a particular service operation, computer 80 begins collecting data pertaining to that operation as the operation is being performed.

In the case of pulling rods, computer 80 may record several transducer readings, one of which may be the change in load carried by hoist 78. To do this, a transducer 1 senses the weight which hoist 76 applies to vehicle 72. In response to the applied weight or load, transducer 1 generates an electrical signal 11. A conventional A/D converter associated with or incorporated within computer 80 converts electrical signal 11 (or any other electrical signal) to a digital value 21, which is then stored on computer 80. Computer 80 then creates and/or displays report 34 which, in this simplified example, comprises contractor identifier 90, service operation identifier 94, and digital value 21.

Computer 80 may collect and record numerous other transducer readings that help substantiate various service operations are actually being performed. For example, when pumping fluid 56 (e.g., hot oil, chemical, acid, gas, water, steam, cement, etc.) a transducer 2 can monitor things such as the fluid's volume or mass flow rate, pressure, temperature, acidity, or concentration. In some service operations, such as the removal and replacement of sucker rods 42, packer glands, tubing 40, etc., a transducer 3 (e.g., a proximity switch) could determine whether parts are being removed or installed. When replacing sucker rods 42 or other well components, transducer 1 could monitor the load carried by hoist 78 while another transducer 4 could monitor a hoist engine speed. Together, transducers 1 and 4 could monitor the power required to pull rods 42 or tubing 40 from the well bore. For tongs 76, which are powered by a hydraulic system on vehicle 72, a transducer 5 can be used to monitor or control the tong's hydraulic pressure or torque. Another transducer 6 can be used to monitor or control the tong's rotational speed. Transducer 7 can indicate the density of the ground surrounding casing 36 or can indicate the integrity or wall thickness of casing 36. The term, "transducer" refers to any device that provides an electrical signal in response to sensing a condition or status of a service operation. Examples of a transducer include, but are not limited to, a pressure switch, a strain gage, a temperature sensor, a flow meter, a tachometer, a limit switch, a proximity switch, etc. For the embodiment of FIG. 1, transducers 1, 2, 3, 4, 5, 6 and 7 respectively provide electrical signals 11, 12, 13, 14, 15, 16 and 17, which in turn are converted to digital values such as signals 11 and 12 being converted to digital values 21 and 22 respectively. Of the digital values generated from transducers 1–7, any or all may be recorded as part of report 34. Report 34 may include several samplings of several transducers, several samplings of just one transducer, or just one reading of just one transducer.

Other information may also be included in report 34. For example, report 34 may include one or more time stamps 98 that indicate the time of day that one or more particular service operations, such as pulling rods, were being performed. Time stamp 98 can be provided by an internal clock of computer 80 and can appear in various formats, including, but not limited to, a chart, graph, single entry, etc. Report 34 may also include a journal entry 101 (e.g., in a text format) that identifies or describes an accident or some other adverse incident (injury, oil spill, damage to equipment, etc.) that may have occurred at well site 32.

Report 34 may store or document much more information and may span several days. For example, later in the day or on another day, contactor 46 may perform another service operation, such as "Pulling Tubing." Computer 80 would then collect another set of data pertaining to the removal of tubing.

In some cases, a second contractor 48 operating vehicle 74 may perform yet another service operation. In this case, contractor 48 would enter (indicated by arrow her contractor identifier 102, which may identify the contractor's name or identify an employee of the contractor, as indicated by employee identifier 104. If contractor 48 selects "Pumping" as a service operation, computer 80 may collect and store data pertaining to a pumping operation. For instance, report 34 may include one or more time stamps 100 and one or more values 22 that correspond to readings from transducer 12.

It should be noted that the format of report 34, as shown in FIG. 2, is for illustrative purposes to clarify the overall idea of the invention. The actual format of report 34 could vary widely and still remain well within the scope of the invention. For example, in some embodiments of the invention, report 34 is displayed on computer 80 through several different screens that a user can view by scrolling or paging up or down through the various screens (wherein a screen is a one-page display on a computer monitor). If desired, well site identifier 84, contractor identifiers 90 and 102, employee identifiers 92 and 104, digital values 21 and 22, time stamps 98 and 100, one or more service operation identifiers of menu 96, and journal entry 101 can each appear on a different screen. Likewise, a printed version of report 34 may also be on one or more pages.

From computer 80, report 34 (i.e., in its entirety or portions of it) can be communicated by way of a wireless communication link 106 to another computer 108 at a remote location 110, such as a home base from which company 44 operates. The term, "remote location" refers to a location that is beyond the immediate property or land on which well 30 is contained or one mile away from well 30, whichever is greater. The term "wireless communication link" refers to data being transmitted over a certain distance, wherein over that certain distance the data is transmitted through a medium of air and/or space rather than wires. Wireless communication link 106 is schematically illustrated to represent a wide variety of systems that are well known to those skilled in the art of wireless communication. For example, with a modem 112 and an antenna 114 associated with computer 108, and another modem 116 and an antenna 118 for computer 80, data of report 34 can be exchanged between computers 80 and 108 using the Internet and any one of a variety of common formats including, but not limited to, HTML, e-mail, etc. Thus, company 44 is provided with access to report 34 as the report is being created or soon after one or all of the service operations are complete.

It should be noted that method 28 is particularly useful when contractors 46 and 48 are independent contractors, and vehicles 72 and 74 each assist in performing a different service operation. The term, "independent contractors" refers to contractors that are not employees of company 44, wherein each contractor has their own employees.

Although the invention is described with reference to a preferred embodiment, it should be appreciated by those skilled in the art that various modifications are well within the scope of the invention. Therefore, the scope of the invention is to be determined by reference to the claims that follow.

I claim:

1. A method of monitoring operations of a first contractor servicing a well at a well site, comprising:

transporting a first computer to the well site;

identifying on the first computer a first contractor identifier that represents the first contractor;

identifying on the first computer a first service operation identifier of a plurality of service operation identifiers, wherein the first service operation identifier represents a first service operation pertaining to the well;

performing the first service operation;

generating a first electrical signal in response to performing the first service operation;

converting the first electrical signal to a first digital value;

storing the first digital value on the first computer; and creating a cohesive report that includes the first contractor identifier, the first service operation identifier, and the first digital value.

2. The method of claim 1, further comprising:

identifying on the first computer a second service operation identifier of the plurality of service operation identifiers, wherein the second service operation identifier represents a second service operation;

performing the second service operation;

generating a second electrical signal in response to performing the second service operation;

converting the second electrical signal to a second digital value; and storing the second digital value on the second computer, wherein the cohesive report includes the first contractor identifier, the first service operation identifier, the second service operation identifier, the first digital value, and the second digital value.

3. The method of claim 1, further comprising:

identifying on the first computer a second contractor identifier that represents a second contractor;

identifying on the first computer a second service operation identifier of the plurality of service operation identifiers, wherein the second service operation identifier represents a second service operation, performing the second service operation by way of the second contractor;

generating a second electrical signal in response to performing the second service operation;

converting the second electrical signal to a second digital value; and storing the second digital value on the second computer, wherein the cohesive report includes the first contractor identifier, the second contractor identifier, the first service operation identifier, the second service operation identifier, the first digital value, and the second digital value.

4. The method of claim 1, further comprising entering into the first computer a journal entry of an incident that occurred at the well site.

5. The method of claim 1, wherein the incident pertains to an accident.

6. The method of claim 1, further comprising creating a time stamp that identifies a time of day that the first service operation was performed, and storing the time stamp on the first computer, whereby the cohesive report includes the first contractor identifier, the first service operation identifier, the first digital value, and the time stamp.

7. The method of claim 1, wherein the first contractor identifier includes an employee identifier that represents an employee of the first contractor.

8. The method of claim 1, further comprising identifying on the first computer a first well site identifier that identifies the well site, wherein the cohesive report includes the first contractor identifier, the first service operation identifier, the first digital value, and the well site identifier.

9. The method of claim 1, wherein a first service vehicle assists the first contractor in performing the first service operation.

10. The method of claim 9, wherein the first service vehicle transports the first computer to the well site.

11. The method of claim 3, wherein a first service vehicle assists the first contractor in performing the first service operation and a second service vehicle assists the second contractor in performing the second service operation.

12. The method of claim 1, further comprising providing a wireless communication link between the first computer and a second computer at a remote location relative to the first computer; and communicating the cohesive report from the first computer to the second computer through the wireless communication link.

13. The method of claim 1, wherein the first electrical signal is provided by a transducer that senses pressure.

14. The method of claim 1, wherein the first electrical signal changes in response to a change in a rotational speed of a motor associated with the first service operation.

15. A method of monitoring operations of a first service vehicle and a second service vehicle at a well site, wherein the first service vehicle and the second service vehicle assist in performing a first service operation and a second service operation respectively, comprising:

transporting a first computer to the well site;

generating a first electrical signal from a first transducer that detects that the first service vehicle is assisting in performing the first service operation;

generating a second electrical signal from a second transducer that detects that the second service vehicle is assisting in performing the second service operation;

converting the first electrical signal to a first digital value;

storing the first digital value on the first computer;

converting the second electrical signal to a second digital value;

storing the second digital value on the first computer;

associating the first digital value with a first time stamp that indicates when the first service vehicle was assisting in performing the first service operation;

associating the second value with a second time stamp that indicates when the second service vehicle was assisting in performing the second service operation; and creating a cohesive report that includes the first digital value, the first time stamp, the second digital value and the second time stamp.

16. The method of claim 15 further comprising identifying on the first computer a first contractor identifier that identifies a first contractor performing the first service operation, wherein the cohesive report further includes the first contractor identifier.

17. The method of claim 15, further comprising providing a wireless communication link between the first computer and a second computer, wherein the second computer is at a location that is remote relative to the well site; and communicating the cohesive report from the first computer to the computer through the wireless communication link.

18. The method of claim 15, further comprising identifying on the first computer a first well site identifier that identifies the well site, wherein the cohesive report further includes the first well site identifier.

19. The method of claim 15, wherein the first transducer senses pressure.

20. A method of monitoring operations of a first contractor servicing a well at a well site, wherein the first contractor uses a first service vehicle in servicing the well, comprising:

transporting a first computer to the well site;

identifying on the first computer a first well site identifier that identifies the well site;

identifying on the first computer a first contractor identifier that represents the first contractor;

identifying on the first computer a first service operation identifier of a plurality of service operation identifiers, wherein the first service operation identifier represents a first service operation pertaining to the well;

performing the first service operation;

generating a first electrical signal in response to performing the first service operation;

converting the first electrical signal to a first digital value;

storing the first digital value on the first computer;

creating a first time stamp that identifies a first time of day that the first service operation was performed;

storing the first time stamp on the first computer;

identifying on the first computer a second service operation identifier of the plurality of service operation identifiers, wherein the second service operation identifier represents a second service operation pertaining to the well;

performing the second service operation;

generating a second electrical signal in response to performing the second service operation;

converting the second electrical signal to a second digital value;

storing the second digital value on the first computer;

creating a second time stamp that identifies a second time of day that the second service operation was performed;

storing the second time stamp on the first computer; and creating a cohesive report that includes the first well site identifier, the first contractor identifier, the first service operation identifier, the first digital value, the first time stamp, the second service operation identifier, the second digital value, and the second time stamp.

* * * * *